United States Patent [19]

Yamazawa

[11] Patent Number: 4,474,124

[45] Date of Patent: Oct. 2, 1984

[54] MULTIPLE NEEDLE SEWING MACHINE

[75] Inventor: Masayuki Yamazawa, Kariya, Japan

[73] Assignee: Aisin Seiki Kabushiki Kaisha, Kariya, Japan

[21] Appl. No.: 466,189

[22] Filed: Feb. 14, 1983

[30] Foreign Application Priority Data

Feb. 12, 1982 [JP] Japan ..... 57-21866

[51] Int. Cl.[3] ..... D05B 55/16

[52] U.S. Cl. ..... 112/167; 112/98; 112/221

[58] Field of Search ..... 112/98, 163, 226, 167, 112/221

[56] References Cited

U.S. PATENT DOCUMENTS 1,676,853 7/1929 Brase ..... 112/167

3,763,805 10/1973 Weigert ..... 112/167 X 4,301,756 11/1981 Teetz et al. ..... 112/221

FOREIGN PATENT DOCUMENTS 2418799 12/1974 Fed. Rep. of Germany ..... 112/98

*Primary Examiner*—Werner H. Schroeder

*Assistant Examiner*—Andrew M. Falik

*Attorney, Agent, or Firm*—Sughrue, Mion, Zinn, Macpeak & Seas

[57] ABSTRACT

In a multiple needle sewing machine having a plurality of needle bars and a block member to which they are moveably mounted, a lever device can be located at any one of a plurality of positions corresponding to that of a specific needle bar. During transfer of the lever from one position to another, the block member is moved across the feeding line of a workpiece to be sewn and another needle bar corresponding to another lever position is brought into operative connection with a crank.

1 Claim, 12 Drawing Figures

FIG. 2
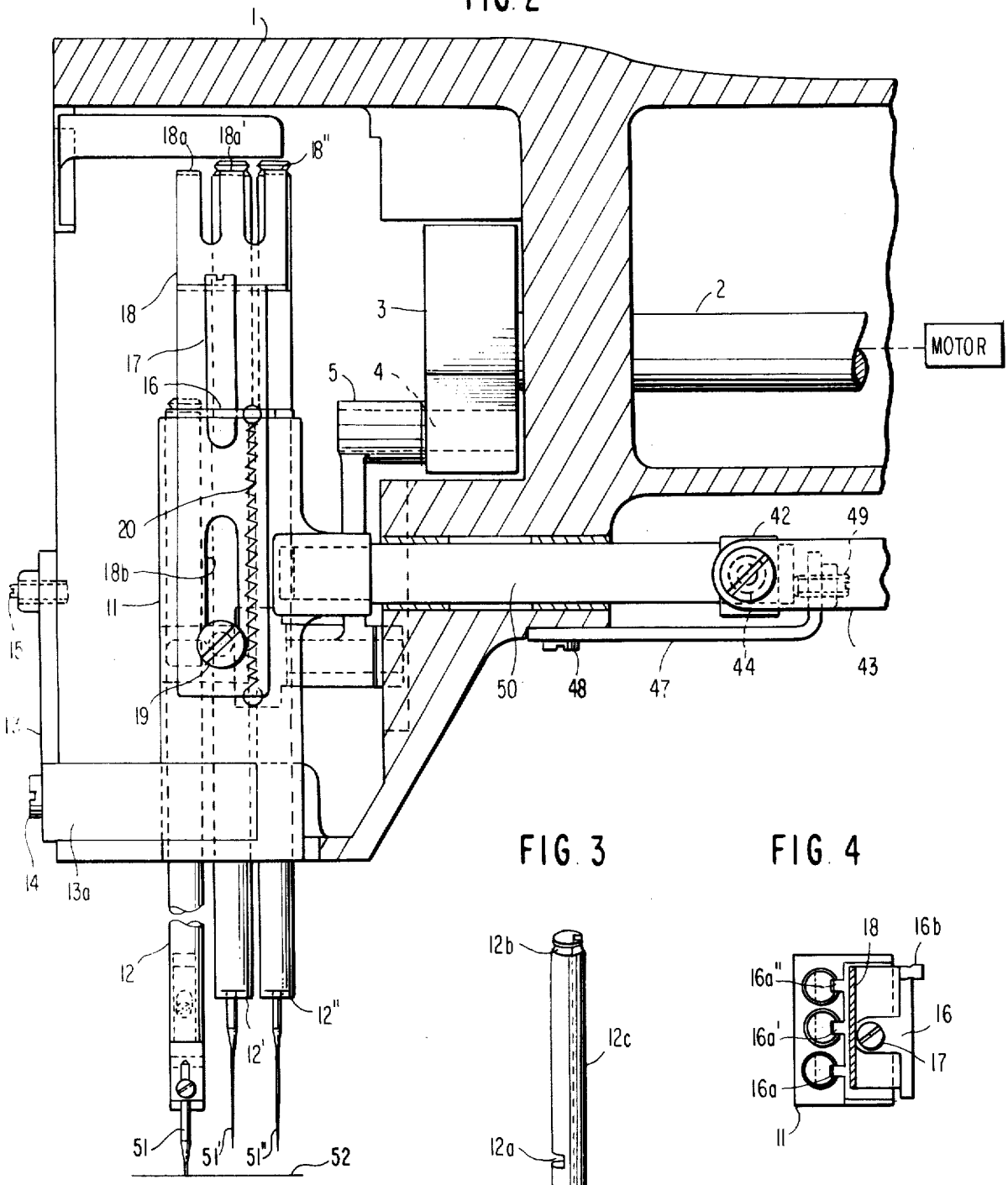
FIG. 3
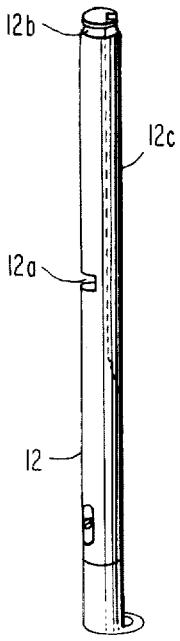
FIG. 4

FIG. 9
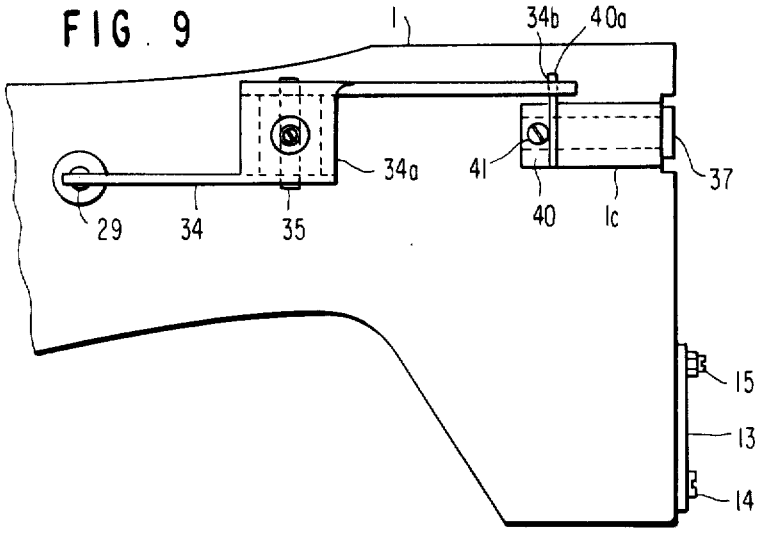
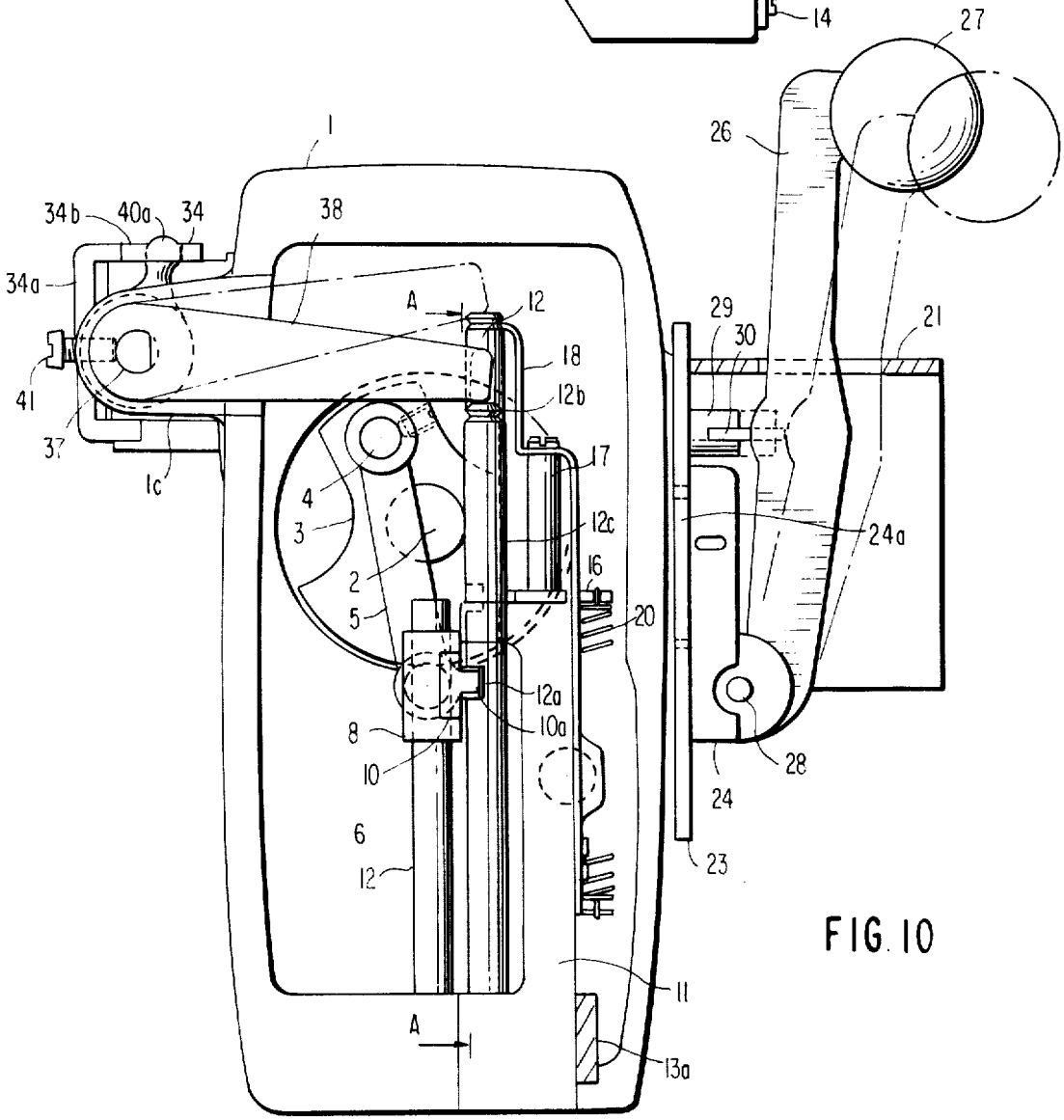
FIG. 10

MULTIPLE NEEDLE SEWING MACHINE

BACKGROUND OF THE INVENTION

1. Field of the Invention:

This invention relates to a multiple needle sewing machine or an embroidery machine, and more particularly relates to a needle changing means of the machine.

2. Description of the Prior Art:

A conventional multiple needle sewing machine or an embroidery machine has a block member to which a plurality of needle bars are provided movably in the vertical direction. The aforementioned machine has also a first means for arranging the plural needle bars at equal height, a second means for maintaining the resulting condition after completion of the operation of the first means, and a third means for moving the block member across a feeding line of a work to be sewn upon needle changing. Aforementioned three means are respectively controlled. In other words, each means has a control mechanism therefor. Thus, a conventional machine is rather or comparatively complex in construction.

SUMMARY OF THE INVENTION

It is, therefore, an object of this invention to provide a multiple needle sewing machine having a needle changing means by which needle change operation may be performed by a single lever transferring action.

BRIEF DESCRIPTION OF THE DRAWINGS

FIG. 2 is a partial sectional view of a portion of an arm, FIG. 3 is a perspective view of a needle bar, FIG. 4 is a cross sectional view along IV—IV line in FIG. 1, FIG. 9 is a rear side view of the arm, and FIGS. 10, 11 and 12 are views for showing operation upon needle changing by the lever of FIG. 7.

DETAILED DESCRIPTION OF THE PREFERRED EMBODIMENT

Figure 1:
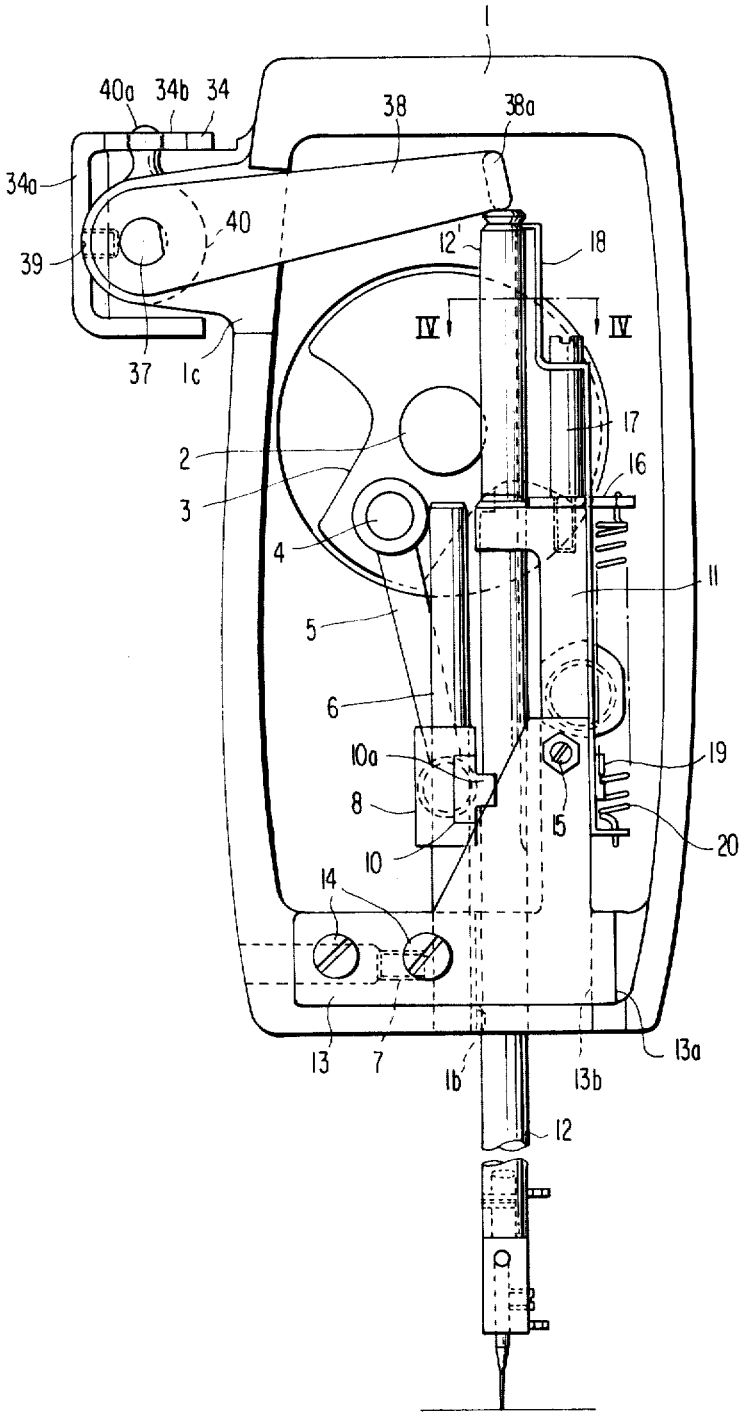
FIG. 1 is side view of a multiple needle sewing machine in which a side plate is removed.
Figure 5:
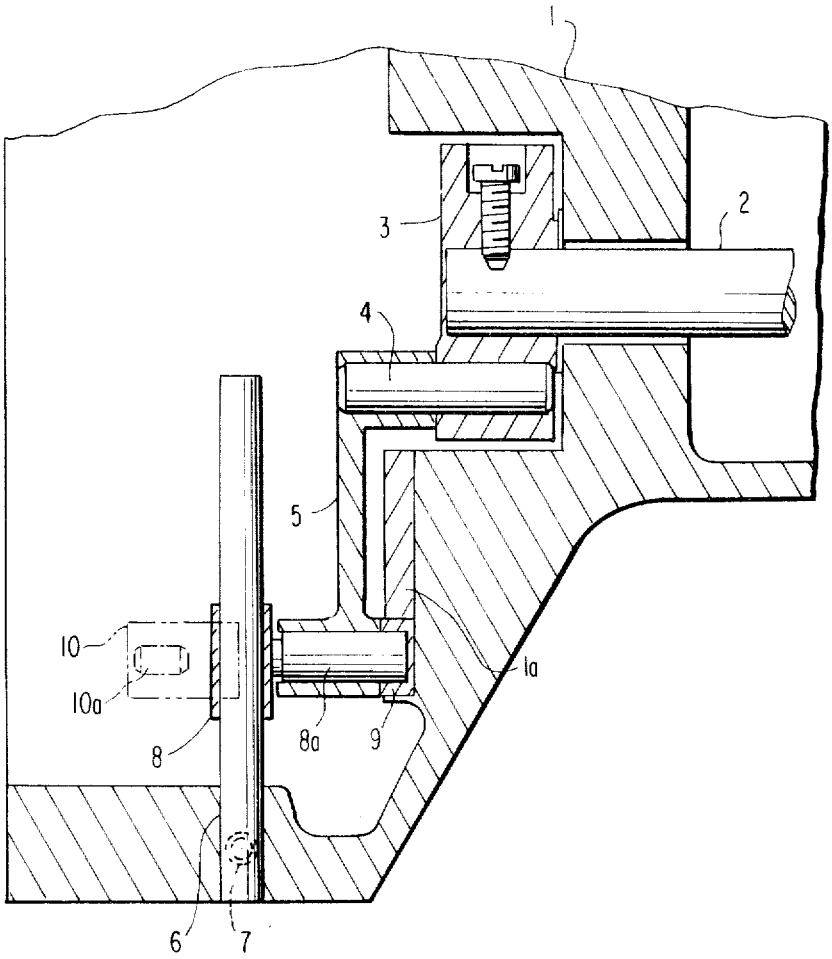
FIG. 5 is a view for showing the relationship between a main shaft and a crank.

Referring now to FIGS. 1 through 12, numeral 1 denotes an overhanging arm having therein a main shaft 2 and a needle bar crank 3 rotable together with the main shaft 2. The main shaft 2 is so constracted that it may be rotated by a driving means such as a motor.

The crank 3 is fixedly connected with a pin 4 which is rotatably connected to an upper end portion of crank rod 5. A guide member 6 is secured to the arm 1 by a screw means 7. On the guiding member 6, there is slidably mounted a sliding member 8 having an axial portion 8*a*. The axial portion 8*a* is loosely passed through a lower end portion of the crank rod 5 and is fixedly connected with a crank slide block 9 which is slidably fitted in a vertical groove 1*a* of the arm 1. The sliding member 8 is also connected having a member 10 with a projection 10*a*. Thus, the member 10 and the sliding member 8 are moved on the guide member 6 in the vertical direction upon rotation of the main shaft 2.

Three parallel bars 12*a*, 12' and 12'' are arranged in a block member 11 so as to be movable in the vertical direction. Any one of the three needle bars 12, 12' and 12'' is brought into engagement with the projection 10*a* by moving the block member 11 across the feeding line of the work as described later in detail.

Numeral 13 denotes a guide member with a bent portion 13*a* and is fixed to the arm 1 by a screw means 14. An inner face 13*b* of the bent portion 13*a* is so opposed to an inner surface 1*b* of the arm 1 that the block member 11 may be movable between the inner surfaces 13*b* and 1*b*. The leftward movement of the block member 11 in FIG. 2 is ajustable by a screw means 15.

As seen from FIG. 3, the needle bar 12 has a slot 12*a*, an annular V-groove 12*b* and a longitudinal groove 12*c*. The needle bars 12' and 12'' have a similar construction to the needle bar 12.

Numeral 16 denotes a plate having three projections 16*a*, 16*b* and 16*c*, and is fixed to the block member 11 by a screw means 17. The projections 16*a*, 16*b* and 16*c* are respectively in engagement with the longitudinal grooves 12*c*, 12'*c* and 12''*c* so as to prevent the rotation of the needle bars 12, 12' and 12''.

Numeral 18 denotes a slightly flexible plate having at the lower end portion thereof a slot 18*b*. The plate 18 is movably connected to the block member 11 by a stepped screw means 19 in the vertical direction. An upper end portion of the plate 18 is bent substantially perpendicular thereto and is divided into three pawl portions 18*a*, 18*a'* and 18*a''*.

Between the plates 16 and 18, there is disposed a spring 20 so as to lift the plate 18 in the upward direction. Thus, the three pawl portions 18*a*, 18*a'* and 18*a''* of the plate 18 are respectively in engagement with grooves 12*b*, 12'*b* and 12''*b* of the needle bars. In FIGS. 1 and 2, only the slot 12*a* of the needle bar 12 is in engagement with the projection 10*a* of the member 10 so that the needle 51 connected to the needle bar 12 may be used and the grooves 12'*b* and 12''*b* of the other needle bars are respectively in engagement with the pawl portions 18*a'* and 18*a''* so that needles 51' and 51'' respectively connected to the needle bars 12' and 12'' may be spaced from a throat plate 52 at a distance while the needle 51 is being in use.

Figure 6:
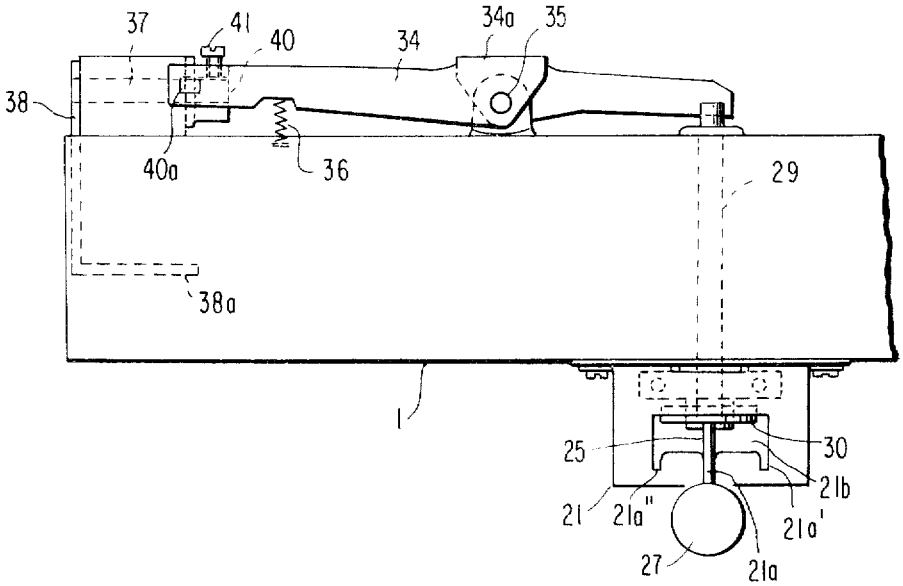
FIG. 6 is a portion of a top view of an arm.
Figure 7:
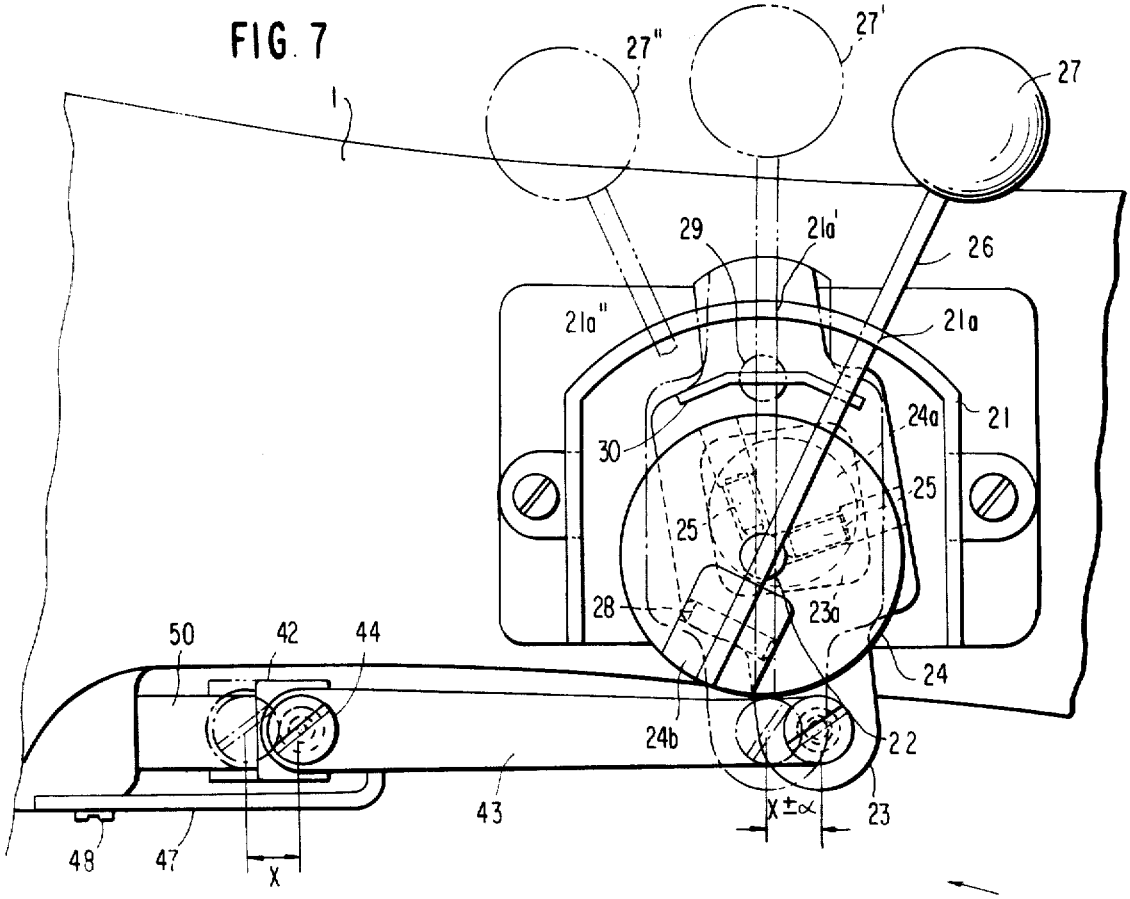
FIG. 7 is a front view of a lever for needle bar changing.
Figure 8:
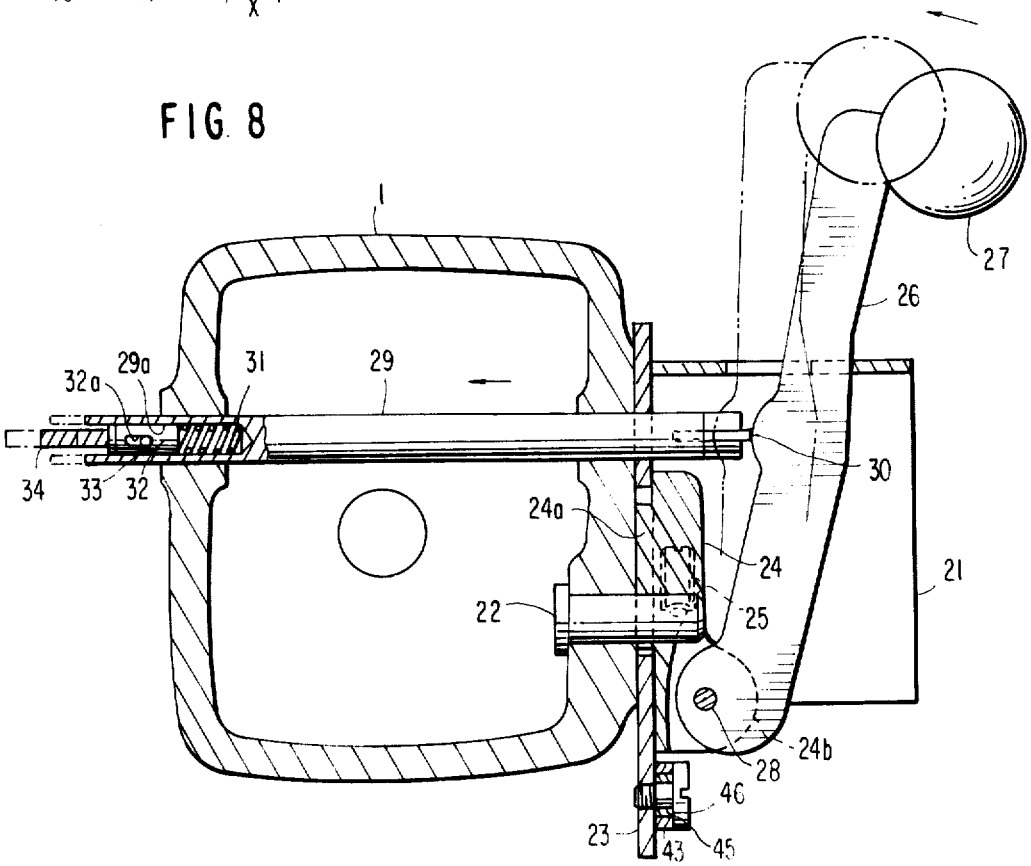
FIG. 8 is a side view of the lever of FIG. 7.

A bracket 21 is fixedly connected to the front side of the arm 1 as seen from FIGS. 6 thru 8 and has an open space 21*b* in the upward direction. The space 21*b* is provided at the side wall thereof with three notches 21*a*, 21*a'* and 21*a''*. A shaft 22 is rotatably connected to the front side of the arm 1 and is secured with a plate 24 having a cam portion 24*a* by a screw means 25. Between the plate 24 and the front side of the arm 1, there is inserted a swing plate 23 having a substantially rectangular aperture 23*a* whose four corners are curved or rounded. The cam portion 24*a* of the plate 24 is fitted in the rectangular aperture 23*a* so that the swing plate 23 may be moved together with movement of the plate 24.

An operating lever 26 is provided at an upper end portion with a knob 27 and a lower end portion of the lever 26 is pivotably connected to an ear portion 24*b* of the plate 24.

A pushing rod 29 passing through the arm 1, is provided at the right end portion with a tongue portion 30 so as to be engageable with the lever 26. At a left portion of the rod 29, there is formed a bore 29*a* in which a spring 31 is inserted for urging a slider 32 within a slot 32a. A pin 33 is passed through the rod 29 and is in sliding engagement with the slot 32a so that the slider 32 may be movable at a distance (FIG. 8).

At the rear side of the arm 1, a swing member 34 is located and pivoted thereto at a center portion 34a of the member 34 (FIGS. 6 and 9). In FIG. 6, the swing member 34 is urged by a spring 36 disposed between the member 34 and the arm 1 and is rotated in the clockwise direction with the result that the member 34 is brought into engagement with the left end portion of the rod 29.

At a rear projection 1c, there is loosely inserted a shaft 37 to which a lever 38 is fixedly connected by a screw means 39 (FIG. 1), and to which a swing member 40 with a projection 40a is fixedly connected by a screw means 41 (FIGS. 1 and 9). As seen from FIG. 6, the lever 38 has a horizontal portion 38a which is located above the needle bars 12, 12' and 12".

On the arm 1, there is movably supported a shaft 50 opposite end portions of which are respectively connected to the block member 11 and a connecting member to which a screw means 44 is connected. Numeral 43 denotes a rod and opposite end portions thereof are respectively connected to the shaft 50 via screw means 44 and the swing plate 23 by a stepped screw means 46. Numeral 47 denotes a stopper having a horizontal portion connected to the arm 1 by a screw means 48 and a upward portion with adjustable screw means 49. Movement of the shaft 50 is restricted by the screw means 49 (FIGS. 2 and 9).

In operation, when the knob 27 is pushed in the frontward direction or is moved from a solid line position to a phantom line position in FIG. 8, the lever 26 is rotated about the pin 28 in the counter-clockwise direction with the result that the lever 26 is disengaged from the notch 21a". Due to the counterclockwise or frontward movement of the lever 26, the rod 29 is brought into movement against the spring 31 in the frontward direction and then the swing member 34 is rotated in the counterclockwise direction against the spring 36 (FIG. 6).

Figure 11:
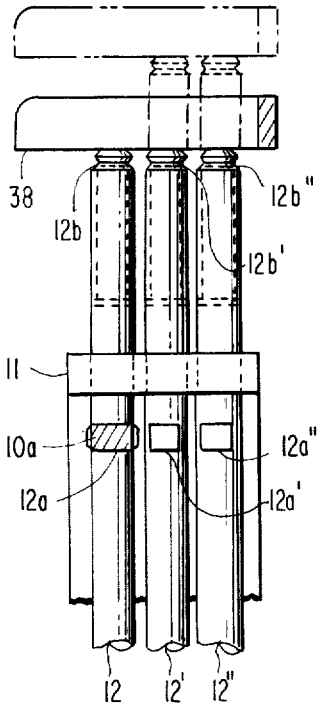

Upon the counterclockwise rotation of the swing member 34, the projection 40a of the swing member 40 is brought into engagement with the end portion of the slot 34b and is rotated in the clockwise direction. The swing member 40 and the lever 38 are so connected on the common shaft 37 that the lever 38 is then moved in the clockwise direction (FIG. 10). Particularly, as to the lever 38, due to the clockwise rotation thereof, the horizontal portion 38a of the lever 38 is lowered and is brought into engagement with the needle bars 12' and 12". Upon further downward movement of the horizontal portion 38a of the lever 38, the height of the needle bars 12' and 12" is lowered against the pawl portions 18a' and 18a" so as to be equalized to that of the needle bar 12. In detail, slots 12a, 12'a and 12"a are brought into alignment with each other in the horizontal direction (FIGS. 10 and 11).

Next, under this condition wherein slots 12a, 12'a and 12"a are in alignment with each other, the knob 27 is transferred from the solid line position to the phantom line position indicated at 27" (FIG. 7). Upon aforementioned transfer of the knob 27, the knob 27, the lever 26, the plate 24 with the cam portion 24a and the swing plate 23 are rotated in the counter-clockwise direction. Thus, rod 43 connected to the swing plate 23 and the shaft 50 are moved in the rightward direction with the result that the projection 10a of the member 10 is brought into the slot 12a" of the needle bar 12" (FIG. 12).

Upon release of the knob 27 positioned at 27" after engagement of the projection 10a of the member 10 with the slot 12'a of the needle bar 12", the lever 26 is held in the notch 21a" and the block member 11 is unmoved. Simultaneously, the swing member 34 is returned to its original position after clockwise rotation and the lever 38 is lifted to its original position. After upward movement of the lever 38, the needle bars 12 and 12' are moved in the upward direction by upward urging of the spring 20 and are held at a height upon respective engagement of grooves 12b and 12b' with pawl portions 16a and 16a'.

Figure 12:
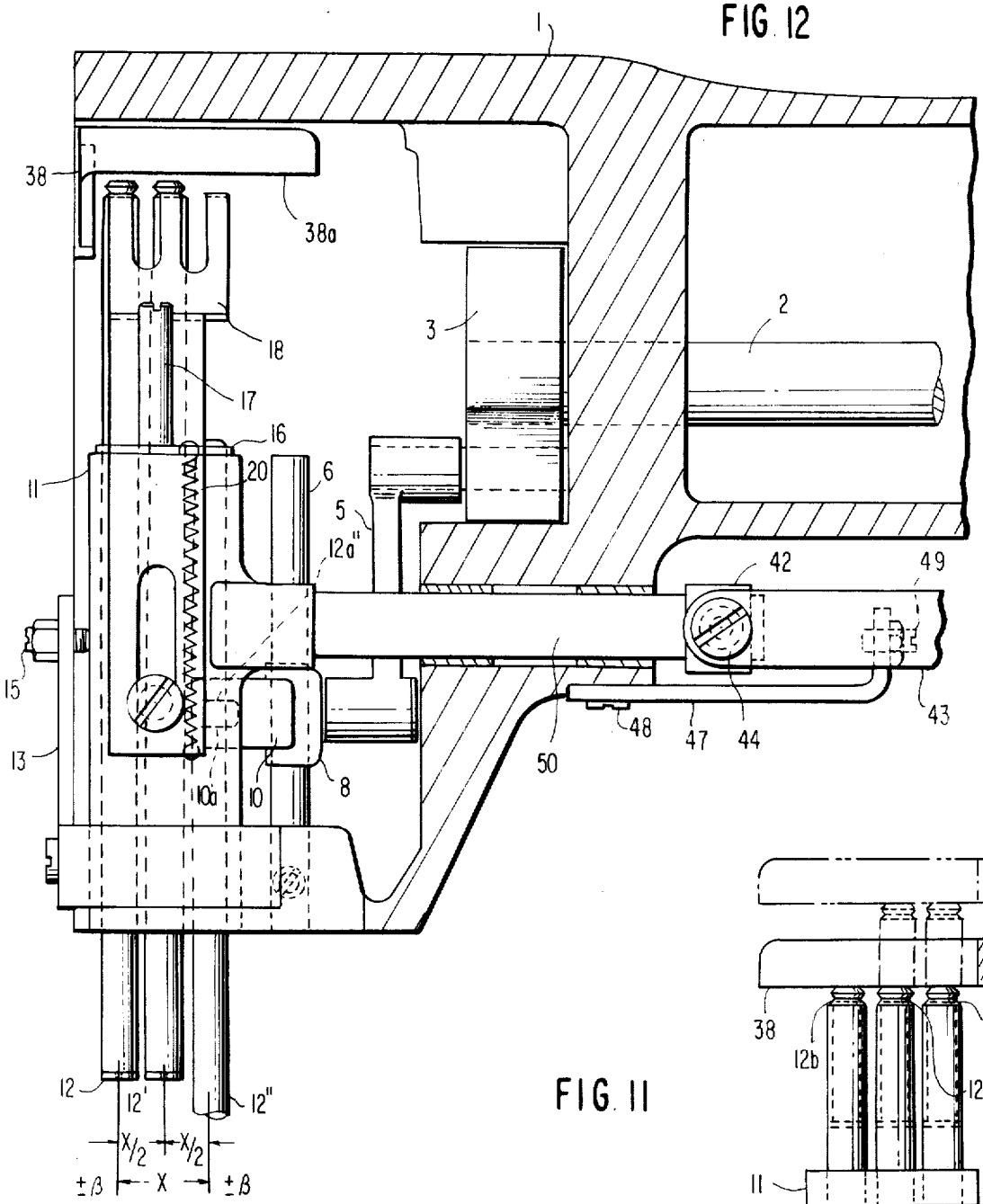

In FIGS. 7 and 12, if the pitch between the needle bars 12 and 12" is indicated by X, the amount of movement of the shaft 50, the rod 43 and the swing member 23 has to be X. However, it is difficult to form the pitch between the needle bars 12 and 12' as X/2 and to form the pitch between the needle bars 12' and 12" as X/2. Therefore, it is possible to generate an error $\beta$ as to each of aforementioned pitches. Similarly, error $\alpha$ is possible as to the amount of movement of the swing member 23. Such errors $\alpha$ and $\beta$ can be eliminated by adjusting the screw means 15 and/or 49.

What is claimed is:

1. A multiple needle sewing machine is which a plurality of needle bars are moveably mounted on a common block member and only one of said needle bars is in engagement with a sliding member operatively connected to a crank means, said machine comprising, a bracket secured to a front side of an arm of said sewing machine and having a plurality of notches corresponding to said needle bars, a plate rotatably connected to said front side of said arm and having a cam portion and an ear portion, a lever pivotably connected at a lower end portion thereof to said ear portion of said plate, said lever being provided at an upper end portion thereof with a knob so as to be rotatable in an angular direction and for engagement with any one of said notches, a first operating means operatively connected to said lever and having a further lever for aligning said needle bars at the same level while said lever is disengaged from said notches, a second operating means operatively connected to said lever, said second operating means being moveable across the feeding line of a work to be sewn during angular transfer of said lever so that another needle bar may be brought into engagement with said sliding member when said lever is in engagement with another notch corresponding to another needle bar, and a third operating means for moving said needle bars except a newly selected needle bar after completion of engagement of said lever with another notch.

* * * * *